US008864914B2

(12) United States Patent
Schlienger

(10) Patent No.: US 8,864,914 B2
(45) Date of Patent: Oct. 21, 2014

(54) SYSTEM, METHOD, AND APPARATUS FOR CLEANING A CERAMIC COMPONENT

(75) Inventor: Max Eric Schlienger, Napa, CA (US)

(73) Assignee: Rolls-Royce Corporation, Indianapolis, IN (US)

( * ) Notice: Subject to any disclaimer, the term of this patent is extended or adjusted under 35 U.S.C. 154(b) by 808 days.

(21) Appl. No.: 12/853,210

(22) Filed: Aug. 9, 2010

(65) Prior Publication Data

US 2011/0030731 A1 Feb. 10, 2011

Related U.S. Application Data

(60) Provisional application No. 61/232,455, filed on Aug. 9, 2009.

(51) Int. Cl.

| | |
|---|---|
| ***B08B 3/04*** | (2006.01) |
| ***B08B 5/04*** | (2006.01) |
| ***B28B 1/00*** | (2006.01) |
| ***B08B 3/08*** | (2006.01) |

(52) U.S. Cl.
CPC ..... *B08B 3/08* (2013.01)
USPC ..... 134/26; 134/30; 134/35; 134/36; 264/630; 264/657

(58) Field of Classification Search
CPC ..... B08B 3/04; B08B 5/04; B28B 1/00
USPC ..... 134/21, 26, 30, 35, 36, 83, 90, 94.1, 134/95.2, 106, 135; 264/657, 630
See application file for complete search history.

(56) References Cited

U.S. PATENT DOCUMENTS

| | | | | |
|---|---|---|---|---|
| 4,575,330 | A | 3/1986 | Hull | |
| 5,143,663 | A * | 9/1992 | Leyden et al. | 264/401 |
| 5,204,055 | A | 4/1993 | Sachs et al. | |
| 5,248,456 | A | 9/1993 | Evans, Jr. et al. | |
| 5,332,023 | A * | 7/1994 | Mills | 164/132 |
| 5,582,650 | A * | 12/1996 | Simons | 134/1 |
| 6,739,380 | B2 | 5/2004 | Schlienger et al. | |
| 7,479,247 | B2 | 1/2009 | Joyner | |
| 2004/0003909 | A1 * | 1/2004 | Schlienger et al. | 164/132 |
| 2004/0119209 | A1 * | 6/2004 | Horn et al. | 264/669 |
| 2004/0159340 | A1 * | 8/2004 | Hiatt et al. | 134/26 |
| 2006/0278254 | A1 * | 12/2006 | Jackson | 134/21 |
| 2008/0149294 | A1 * | 6/2008 | Frasier et al. | 164/256 |
| 2010/0043836 | A1 * | 2/2010 | Osborn | 134/28 |

OTHER PUBLICATIONS

International Search Report and Written Opinion, PCT/US2010/044923, Rolls-Royce Corporation, Oct. 27, 2010.

* cited by examiner

*Primary Examiner* — Saeed T Chaudhry
(74) *Attorney, Agent, or Firm* — Krieg DeVault LLP

(57) ABSTRACT

A method for cleaning a ceramic component includes generating a computer solid model of a component, converting the computer solid model to a stereo-lithographic instruction file, and preparing the component in a stereo-lithography machine in response to the stereo-lithographic instruction file. The method further includes providing an amount of solvent, where a residue left from preparing the component is at least partially soluble in the solvent. The method includes immersing at least part of the component in the solvent, heating the solvent in a liquid state, and reducing a pressure of the solvent sufficiently to boil the solvent. The method further includes heat-curing the component.

14 Claims, 7 Drawing Sheets

SYSTEM, METHOD, AND APPARATUS FOR CLEANING A CERAMIC COMPONENT

CROSS REFERENCE TO RELATED APPLICATIONS

The present application claims the benefit of U.S. Provisional Patent Application No. 61/232,455, filed Aug. 9, 2009, and is incorporated herein by reference.

BACKGROUND

The technical field generally relates to conditioning ceramic casting molds and cores in preparation for casting. A modern casting process for producing complex ceramic components from a computer solid model includes generating the computer solid model, converting the solid model to a stereo-lithographic instruction file, and building the component in a stereo-lithography device from the stereo-lithographic instruction file. The component is built from a ceramic resin, and is a green ceramic stereo-lithography component upon completion. To develop full strength before final utilization, e.g. as a casting mold or core, the component may be fired to cure the component. Residue from the creation process, including uncured resin adhering to the component, can damage the component during the firing process. Removal of residue from the component is challenging in the present art, as the component can include complex passages and areas that are difficult to reach with present available component cleaning technology. Therefore, further technological developments are desirable in this area.

SUMMARY

One embodiment is a unique method for cleaning ceramic components having complex internal structures or passages. The techniques herein may be utilized to clean other components having complex internal structures or passages. Further embodiments, forms, objects, features, advantages, aspects, and benefits shall become apparent from the following description and drawings.

DESCRIPTION OF THE ILLUSTRATIVE EMBODIMENTS

Figure 1:
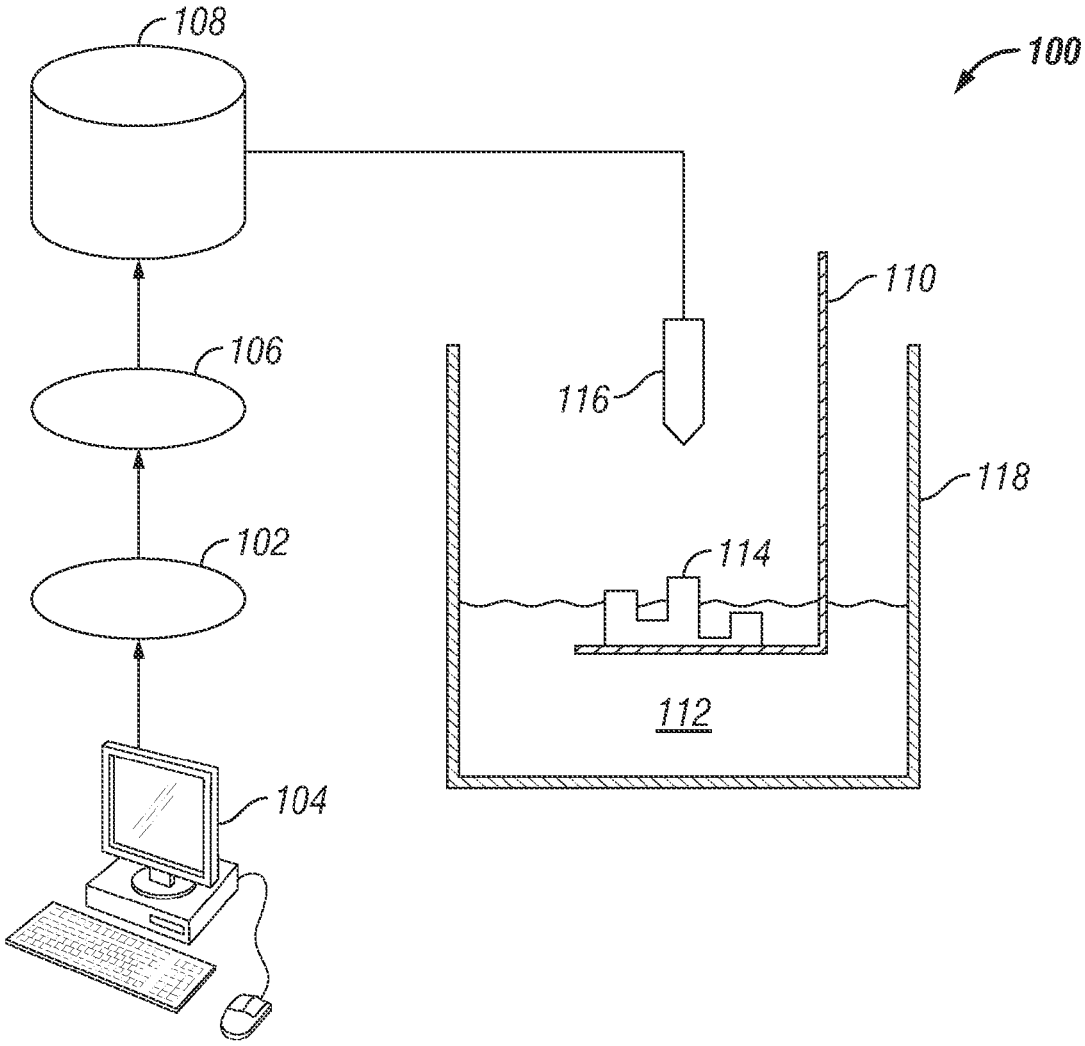
FIG. 1 (Prior Art)
FIG. 1 is a schematic illustration of a system for creating components via stereo-lithography that is available in the present art.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

FIG. 1 is a schematic illustration of a system 100 for creating components via stereo-lithography that is available in the present art. The system includes a computer 104 that is used (e.g. by a user or in an automated process) to create a computer solid model 102 of a component, where the computer solid model 102 is converted into a stereo-lithographic instructions file 106 (e.g. a *.STL file). The system 100 includes a stereo-lithography (SLA) device that includes an SLA controller 108 and a laser 116. A partially completed component 114 sits on a support 110 in a photo-responsive fluid 112 held in a fluid receptacle 118. The photo-responsive fluid may be a photo-setting polymer, a photo-setting resin, or similar fluid. The photo-responsive fluid 112 may include a resin that forms a ceramic substrate in response to light from the laser 116.

The SLA controller 108 operates the laser 116 according to the stereo-lithographic instructions file 106 to add specified layers to the partially completed component 114 until the final component is formed. The final component will have residue from the photo-responsive fluid 112 including resin or the like. Where the component has complex internal surfaces or shapes, cleaning of residue from the component is difficult. Some substrate materials are not at full strength upon completion of forming the component. For example, a ceramic substrate will be a "green" ceramic component and will not have full strength characteristics until after the component is heat-cured (or "fired"). The firing process for a component can cause damage or unacceptable alteration of the component where residue from the photo-responsive fluid 112 is still present during the firing.

Figure 2:
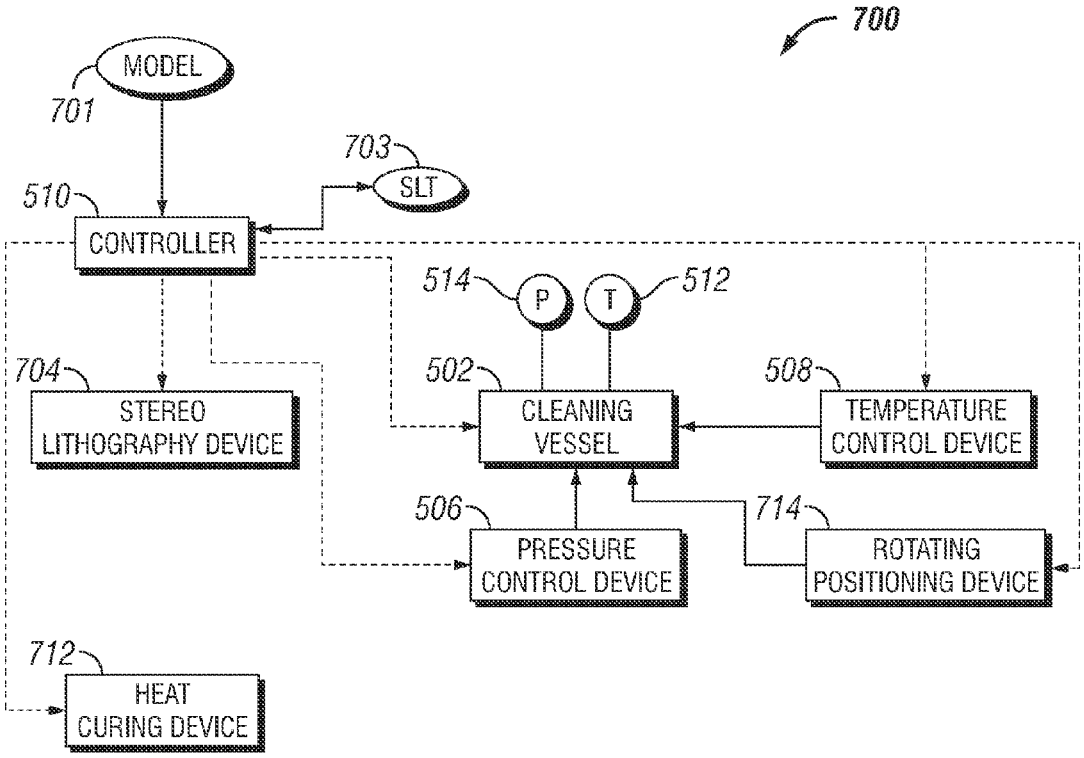
FIG. 2 is a schematic illustration of a system for creating and cleaning a ceramic component.

Referencing FIG. 2, a schematic of a system 700 for creating and cleaning a ceramic component is shown. The system 700 includes a stereolithography device 704 that manufactures a ceramic component having internal passages. The ceramic component may include an internal passage that is complex, tortuous, that does not have a line-of-sight to external to the component, and/or includes passages that require multiple lines-of-sight external to the component for a solvent spray or cleaning instrument to reach all portions of the passage. An exemplary ceramic component includes a turbine wheel, a compressor wheel, a vane, a stator, and/or a part including at least hollow portions or internal cooling passages.

The system 700 further includes a cleaning vessel 514 that contains a solvent, where the cleaning vessel is fluidly coupled to a pressure control device 508. The pressure control device is a pump, piston, or other device structured to provide overpressure or underpressure to the cleaning vessel 502. The cleaning vessel 502 is at least partially sealable, sufficient to allow pressurization or de-pressurization by the pressure control device 508. The pressure control device 508 is responsive to commands by a controller 510. The controller 510 is structured to functionally execute certain operations for cleaning a ceramic component. The controller 510 may be a single device or be distributed across a plurality of devices, and the controller 510 may have portions in hardware or software.

The controller 510 commands the pressure control device to change the pressure in the cleaning vessel 502 such that solvent in the cleaning vessel crosses from a liquid side to a vapor side of a liquid-vapor phase line during a cleaning operation. The controller 510 may be in communication with a temperature 512 and/or pressure 514 sensor. However, the operations of the controller 510 may also be "open loop", i.e. the controller 510 executes pre-planned operations that are calibrated to perform the cleaning operations without sensor feedback. In certain embodiments, the controller 510 operates with differing sensors to those illustrated, and/or calculates values for the pressure and temperature based on other parameters available in the system 700.

An exemplary operation of the pressure control device 506 changes the pressure by de-pressurizing the cleaning vessel until the solvent in the cleaning vessel 502 crosses from the liquid side to the vapor side.

Another exemplary operation of the pressure control device 506 pressurizes the cleaning vessel 502, and a temperature control device 508 elevates the temperature of the solvent in the cleaning vessel 502. The temperature control device 508 may be a heat exchanger, jacket heater, oil heater, burner, electric resistance heater, or other heating device known in the art. The temperature elevation occurs before, during, or after the pressurization, and the temperature control device 508 before the cleaning operation heats the solvent while the solvent remains in a liquid state. The exemplary pressure control device 506 then reduces the pressure until the solvent in the cleaning vessel 502 crosses from the liquid to the vapor side of the liquid-vapor phase line.

In certain embodiments, the controller 510 commands the pressure control device 506 to repeat the pressure reduction cycles a number of times. An exemplary system 700 further includes the cleaning vessel 510 thermally coupled to the temperature control device 508, where the controller 510 commands the temperature control device 508 to re-heat the solvent in response to a temperature of the solvent going below a threshold temperature. In certain embodiments, the exemplary controller 510 commands the pressure control device 506 to re-pressurize the cleaning vessel 502 before the re-heating to ensure the temperature control device 508 does not cause vaporization of isolated portions of the solvent.

The exemplary system 700 further includes a heat curing device 712 that heats the cleaned ceramic component sufficiently to cure the ceramic component. In certain embodiments, the system 700 further includes a positioning device 714. The positioning device 714 positions the ceramic component in the cleaning vessel 502 to vertically orient a surface of the ceramic component during the cleaning operation. Additionally or alternatively, the positioning device 714 rotates the ceramic component during the cleaning operation. Exemplary positioning devices include a basket, baffle, ledge, or shelf within the cleaning vessel 502 that holds the ceramic component in a predetermined position that vertically orients a surface of the ceramic component. Another exemplary positioning device 714 includes a spindle or tray in the cleaning vessel 502 that rotates the component when the component is positioned in the cleaning vessel 502 and the positioning device 714 is activated. The positioning device 714 may include multiple devices that orient or rotate the ceramic component during the cleaning operation, and the multiple devices may work together or in succession (e.g. through each of several cleaning stages).

Figure 3A:
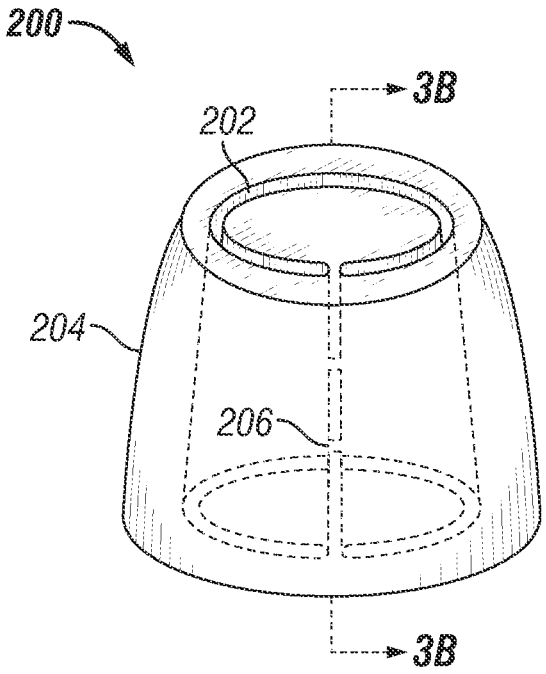
FIGS. 3A and 3B are a schematic illustration of a component having complex internal structures and passages.
Figure 3B:
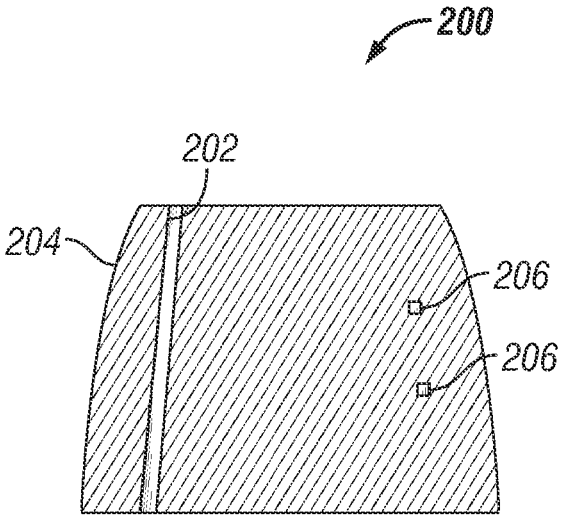

FIG. 3 depicts a schematic illustration 200 of a component 204 having complex internal structures and passages. The component 204 includes a partially annular groove 202 and internal passages 206 that are difficult to clean by simple soaking in a solvent or by washing the component with a solvent spray. The illustrated complex internal structures and passages are exemplary only, and a component 204 may include any kind of internal structure.

Figure 6:
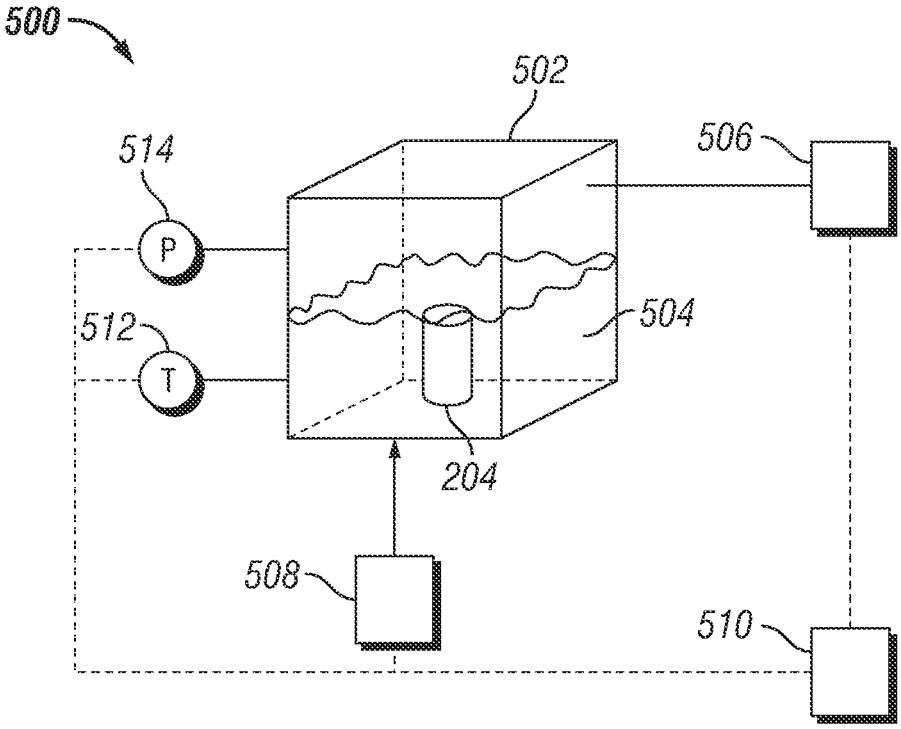
FIG. 6 is a schematic diagram of an apparatus for cleaning a component.

FIG. 6 is a schematic diagram of an apparatus 500 for cleaning a component 204. The apparatus 500 includes a component 204 having a residual resin (not shown) on at least one surface, and a vessel 502 containing an amount of a solvent 504. The component 204 may be a ceramic component, and may be formed by an SLA operation. The residual resin is at least partially soluble in the solvent 504. The apparatus 500 further includes a heater 508 that heats the solvent 504 in the vessel. The heater 508 may be any type known in the art, including without limitation a burner, heat exchanger, and/or an electric heating element. The heater 508 may be in the solvent 504 or in thermal contact with the solvent 504, including through the wall of the vessel 502.

The apparatus 500 further includes a pressure modulator 506 that controls a pressure in the vessel 502. The pressure modulator 506 may be a piston, a pump, a control volume in fluid communication with the fluid in the vessel 502, or any other pressure control device understood in the art. The pressure modulator 506 may be structured to pressurize (i.e. above atmospheric pressure) the solvent 504 in the vessel 502 and/or to apply a vacuum (i.e. below atmospheric pressure) to the solvent 504 in the vessel 502.

In certain embodiments, the vessel 502 is sealed from mass transfer with the external environment outside the vessel, although the vessel 502 does not have to be sealed. For example, where the pressure modulator 506 is a centrifugal pump that can elevate a pressure of the vessel 502, there may be a mass transfer path from the external environment to the vessel 502. The nature of the solvent 504, including cost, environmental characteristics, vapor pressure, and the pressure-temperature values of the liquid-vapor phase line 304 (reference FIG. 3) vary with each system and define whether a sealed or un-sealed vessel 502 is indicated for a specific embodiment.

The apparatus 500 further includes a controller 510 that controls the heater 508 to heat the solvent 504 in a liquid state. Heating the solvent 504 in a liquid state means that the final heated state of the solvent 504 is a liquid state, although in certain embodiments the solvent 504 may be a solid before or during the heating. The controller 510 further controls the pressure modulator 506 to reduce the pressure in the vessel 502 sufficiently to boil the solvent 504. The controller 510 is in communication with the pressure modulator 506, the heater 508, and may further be in communication with a temperature sensor 512 that determines a temperature of the solvent 504, and/or with a pressure sensor 514 that determines a pressure of the solvent 504 in the vessel 502. The reduced pressure in the vessel 502 causing boiling of the solvent 504 at surfaces throughout the vessel 502 rather than at a specific surface that is being heated. Specifically, the surfaces of the component 204 and especially irregular surfaces such as those including residual resin will experience nucleation of the solvent with resulting agitation and mixing.

In certain embodiments, the temperature sensor 512 determines a temperature of the solvent, and the controller 510 controls the pressure modulator 506 to further reduce the pressure in the vessel 502 in response to the temperature of the solvent approaching a liquid-vapor phase temperature (i.e. the liquid-vapor phase line 304). In certain embodiments, the controller 510 controls the pressure modulator 506 to reduce the pressure in the vessel sufficiently rapidly to put the solvent 504 into a superheated state. For example, where the solvent 504 is very near the liquid-vapor phase line 304, and the controller 510 controls the pressure modulator 506 to reduce the pressure in the vessel slowly, the solvent 504 will boil and begin evaporative cooling. The solvent 504 will move along the liquid-vapor phase line 304 and not experience significant departure from the liquid-vapor phase line 304. In another example, the controller 510 controls the pressure modulator 506 to rapidly reduce the pressure in the vessel, and the solvent 504 will boil aggressively. The solvent 504 will depart significantly below the liquid-vapor phase line 304 while still remaining in a bulk liquid state, causing the aggressive boil throughout the solvent 504.

Figure 4:
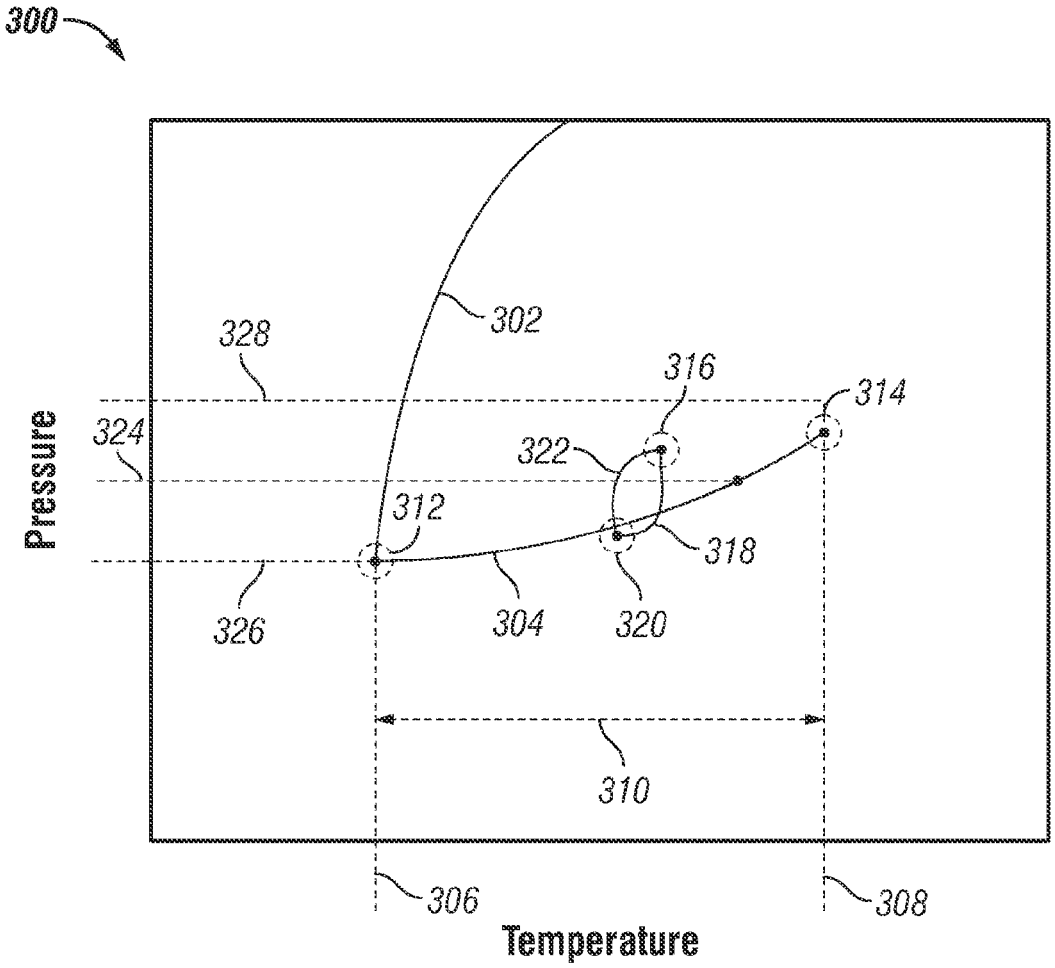
FIG. 4 is an illustration of an illustrative phase diagram and operating curves.

Referencing FIG. 4, a phase diagram 300 for a solvent is illustrated. The phase diagram 300 is exemplary only, having general characteristics that are common to many solvents. The specific phase diagram 300 for a particular solvent is readily obtained by one of skill in the art, and the pressure-temperature points for the controller 510 may also be determined with simple data-taking without the phase diagram 300 for the specific solvent. The solid-liquid phase line 302 is shown but is not of particular interest in the example. The solid-vapor phase line is not shown to avoid cluttering the illustration. The liquid-vapor phase line 304 is shown with the triple point 312 at the left and the critical point 314 at the right. As is known in the art, above the critical temperature 308 the fluid is super-critical at high pressures and super-heated vapor at lower pressures, but does not experience the discontinuous property changes that occur throughout the liquid-vapor phase line 304.

In an example, the solvent 504 is at a first operating point 316 after heating, which includes the solvent as a heated liquid. The pressure modulator 506 decreases the pressure along an operating line 318. The operating line 318 is illustrative, but shows slight cooling until the liquid-vapor phase line 304 is crossed at which point more rapid cooling begins. As the boiling continues, the solvent would again approach the liquid-vapor phase line 304 by experiencing a reduced temperature. In certain embodiments, the controller 510 can cause the pressure modulator 506 to further reduce the pressure of the solvent 504 to continue the boiling, until either the pressure limitations of the pressure modulator 506 or the vessel 502 are approached, or until the solvent approaches a freezing point.

In a further example, the controller 510 commands the heater 508 to re-heat the solvent 504, returning along a second operating line 322 to the first operating point 316 or to some other operating point that includes the solvent as a heated liquid. In certain embodiments, the pressure modulator 506 is capable of modulating the pressure between a triple point pressure 326 and a critical pressure 328 (i.e. along the range 310). The pressure modulator 506 can modulate the pressure through the entire range or within a range of values included in the range. In certain embodiments, the pressure modulator 506 can modulate the pressure below the triple point pressure 326, down to values that prevent the solvent 504 from freezing at temperatures below the triple point temperature 306 or to provide sufficient super-heating of the solvent 504. In the illustration of FIG. 3, the operating point 320 is observed to be a pressure below the triple point pressure 326. An exemplary atmospheric pressure 324 line is shown, illustrating that in the example of FIG. 3 the pressure modulator 506 is capable of applying vessel pressure above and below the triple point pressure 326. The position of the atmospheric pressure 324 line relative to the liquid-vapor phase line 304 will vary with the specific solvent utilized.

In certain embodiments, the component 204 is positioned in the vessel 502 such that a surface to be cleaned is positioned vertically. Vertical positioning of cleaned surfaces allows nucleation and passage of solvent vapor past the surface increasing agitation and enhancing cleaning. The component 204 may be re-positioned between cleaning stages. In certain embodiments, the component 204 may be rotated, vertically, horizontally, obliquely, or combinations thereof, during the boiling of the solvent 504 which prevents trapping of solvent vapor within passages in the component 204.

Figure 5:
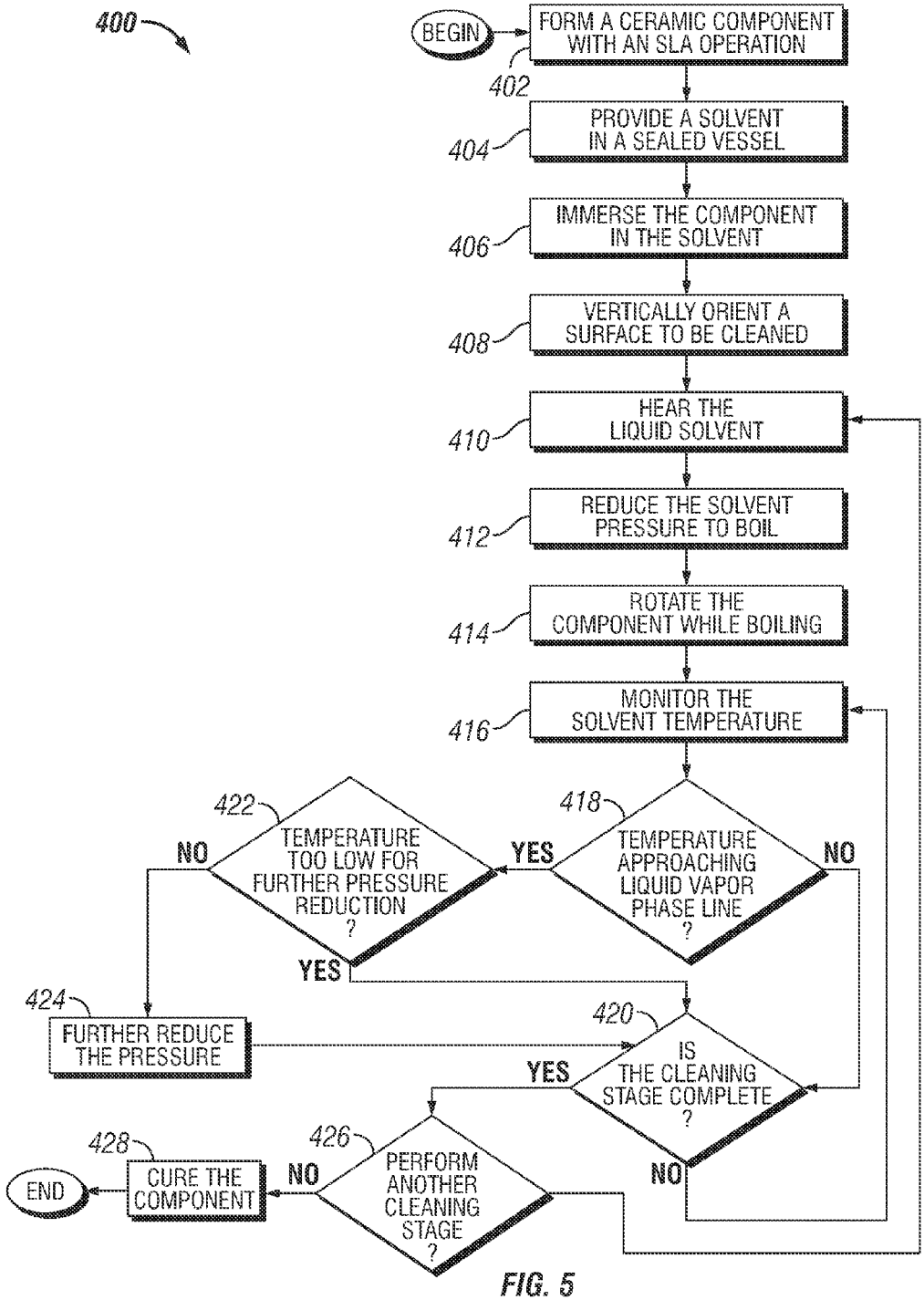
FIG. 5 is a schematic flow diagram of a technique for cleaning a component.

The schematic flow diagrams in FIGS. 5 an 7, and related descriptions which follow, provide illustrative embodiments of performing operations for cleaning components including ceramic components created by stereo-lithography and having complex internal surfaces and/or structures. Operations illustrated are understood to be exemplary only, and operations may be combined or divided, and added or removed, as well as re-ordered in whole or part, unless stated explicitly to the contrary herein. Operations illustrated may be implemented by a computer executing a computer program product on a computer readable medium, where the computer program product comprises instructions causing the computer to execute one or more of the operations.

FIG. 5 is a schematic flow diagram of a technique 400 for cleaning a component. The technique 400 includes an operation to form a ceramic component with a stereo-lithographic operation, where the residue includes a resin from the stereo-lithographic operation. The technique 400 further includes an operation 404 to provide an amount of solvent, wherein the residue is at least partially soluble in the solvent, and an operation 406 to immerse at least part of the ceramic component in the solvent. The technique 400 further includes an operation 408 to vertically orient a surface of the ceramic component that is to be cleaned, and an operation 410 to heat the solvent in a liquid state. The technique 400 further includes an operation 412 to reduce a pressure of the solvent sufficiently to boil the solvent.

In certain embodiments, the technique 400 includes an operation to monitor a temperature of the solvent, an operation 418 to determine whether the temperature of the solvent is approaching a liquid-vapor phase temperature. In response to the temperature of the solvent approaching a liquid-vapor phase temperature, the technique 400 includes an operation 422 to determine whether a temperature of the solvent is too low for further pressure reduction to be possible or allowable. In response to the temperature of the solvent not being too low for further pressure reduction, the technique 400 includes an operation 424 to further reduce the pressure of the solvent.

In response to the temperature of the solvent not approaching the liquid-vapor phase line, and/or the temperature of the solvent being too low for further pressure reduction, the technique 400 includes an operation 420 to determine whether a current cleaning stage is complete. In response to the current cleaning stage not being complete, the technique 400 proceeds with continuing the operation 416 to monitor the solvent temperature. In response to the current cleaning stage being complete, the technique 400 includes an operation 426 to determine whether another cleaning stage is to be performed. In response to determining another cleaning stage is to be performed, the technique 400 proceeds with the operation 410 to heat the liquid solvent. In response to determining another cleaning stage is not to be performed, the technique 400 includes, in certain embodiments, an operation 428 to cure the component.

Figure 7:
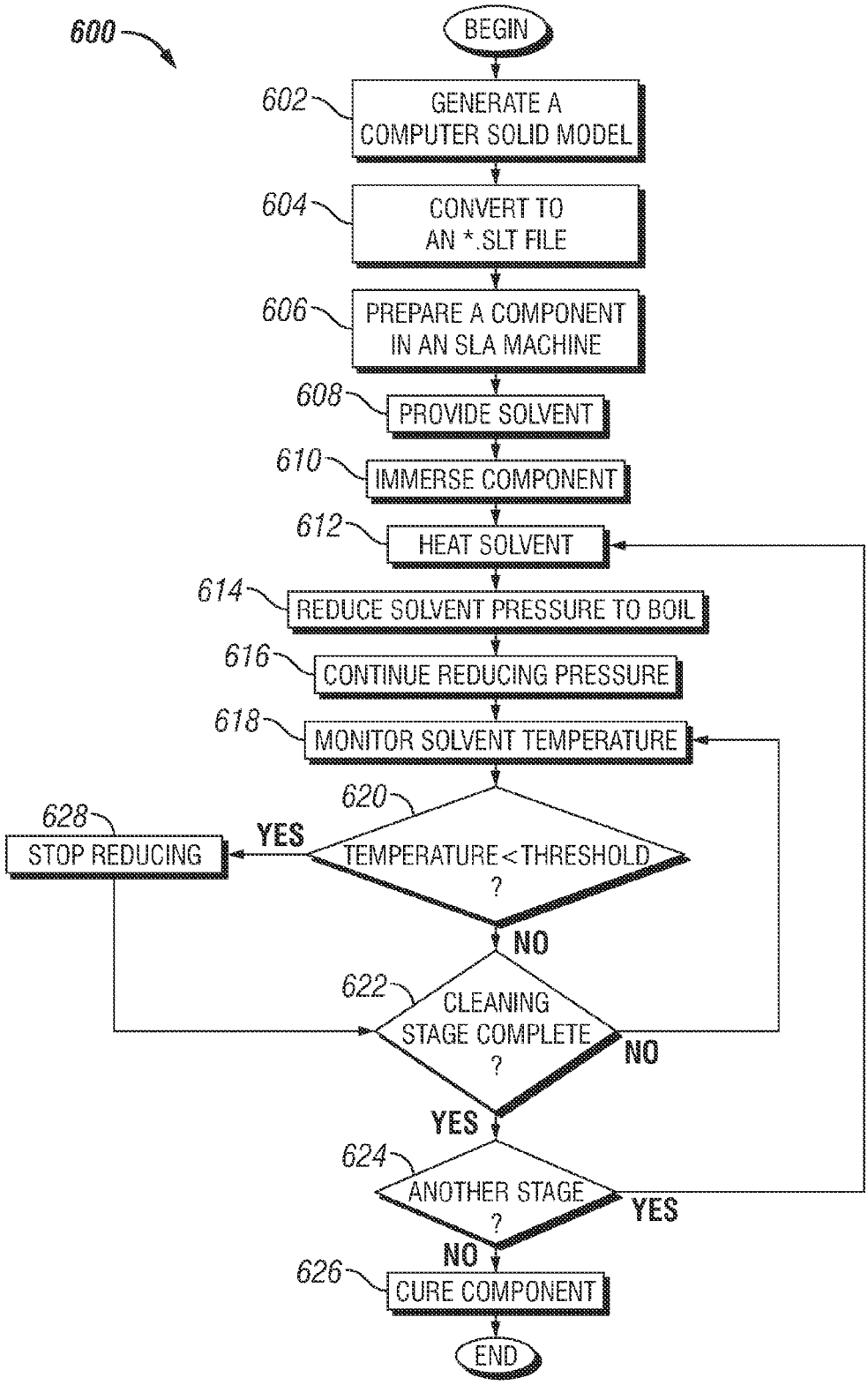
FIG. 7 is a schematic flow diagram of an alternate technique for cleaning a component.

FIG. 7 is a schematic flow diagram of an alternate technique 600 for cleaning a component. The technique 600 includes an operation 602 to generate a computer solid model of a component, an operation 604 to convert the computer solid model to a stereo-lithographic instruction file, and an operation 606 to prepare the component in a stereo-lithography machine in response to the stereo-lithographic instruction file. The technique 600 further includes an operation 608 to provide an amount of solvent, where a residue from preparing the component is at least partially soluble in the solvent, and an operation 610 to immerse at least part of the component in the solvent. The technique 600 further includes an operation 612 to heat the solvent in a liquid state, and an operation 614 to reduce a pressure of the solvent sufficiently to boil the solvent.

The technique 600 further includes an operation 616 to continue reducing the solvent pressure, and an operation 618 to monitor the solvent temperature. The operation 616 to continue reducing the pressure may be performed to keep the solvent on a vapor side of a liquid-vapor phase line. The technique 600 further includes an operation 620 to determine whether the solvent temperature is below a threshold. In response to the solvent temperature being below a threshold, the technique 600 includes an operation 628 to stop the reducing. The technique 600 includes an operation 622 to determine whether a current cleaning stage is complete. In response to the current cleaning stage not being complete, the technique 600 proceeds with continuing the operation 618 to monitor the solvent temperature. In response to the current cleaning stage being complete, the technique 600 includes an operation 624 to determine whether another cleaning stage is to be performed. In response to determining another cleaning stage is to be performed, for example to repeat the operations 612, 614 of heating and reducing the pressure to remove residue from the component, the technique 600 proceeds with the operation 612 to heat the liquid solvent. In response to determining another cleaning stage is not to be performed, the technique 600 includes, in certain embodiments, an operation 626 to cure the component.

In certain embodiments, the technique 600 further includes an operation (not shown) to cast a metal component having complex internal structures utilizing the component cleaned in the technique 600 as a casting core, where the component cleaned in the technique 600 is a ceramic component. The metal component may be any shape, including a complex shape, a shape having internal passages, and/or a shape including an airfoil including, without limitation, a compressor wheel, a turbine wheel, a stator, and/or a vane.

As is evident from the figures and text presented above, a variety of embodiments according to the present invention are contemplated.

One exemplary embodiment is a method for cleaning a residue from a green ceramic component. The method includes providing an amount of solvent, wherein the residue is at least partially soluble in the solvent. The method further includes immersing at least part of the green ceramic component in the solvent, heating the solvent in a liquid state, and reducing a pressure of the solvent sufficiently to boil the solvent. The method further includes forming the green ceramic component with a stereo-lithographic operation, where the residue includes a resin from the stereo-lithographic operation. The method further includes monitoring a temperature of the solvent, and further reducing the pressure of the solvent in response to the temperature of the solvent approaching a liquid-vapor phase temperature.

In certain embodiments, the method includes vertically orienting a surface of the green ceramic component that is to be cleaned, and/or rotating the ceramic component while reducing the pressure of the solvent. The exemplary method further includes reducing the pressure of the solvent sufficiently to put the solvent into a superheated state, including reducing the pressure at a rate sufficient to induce the superheated state. The method further includes reducing the pressure of the solvent by reducing the pressure of the solvent from an elevated state toward atmospheric pressure and/or by reducing the pressure of the solvent from atmospheric pressure to a reduced pressure. In certain embodiments, the method includes providing the amount of solvent in a vessel, and sealing the vessel from external mass transfer during at least one of the heating and reducing.

Another exemplary embodiment is an apparatus including a green ceramic component having a residual resin on at least one surface, and a vessel containing an amount of a solvent where the residual resin is at least partially soluble in the solvent. The apparatus further includes a heater that heats the solvent in the vessel, and a pressure modulator that controls a pressure in the vessel. The apparatus further includes a controller that controls the heater to heat the solvent in a liquid state and that controls the pressure modulator to reduce the pressure in the vessel sufficiently to boil the solvent. The green ceramic component may be a component formed from a stereo-lithographic operation.

In certain embodiments, the apparatus includes a temperature sensor that determines a temperature of the solvent, and the controller controls the pressure modulator to further reduce the pressure in the vessel in response to the temperature of the solvent approaching a liquid-vapor phase temperature. The controller may further control the pressure modulator to reduce the pressure in the vessel sufficiently rapidly to put the solvent into a superheated state. The pressure modulator modulates the pressure by increasing the pressure in the vessel above atmospheric pressure and/or by decreasing the pressure in the vessel below atmospheric pressure. In certain embodiments, the pressure modulator is capable of modulating the pressure between a triple point pressure and a critical pressure, including the entire range or within a range of values included in the range. The vessel may be sealed from external mass transfer.

Another exemplary embodiment is a system including a stereolithography device that manufactures a green ceramic component having internal passages. The system further includes a cleaning vessel that contains a solvent, where the cleaning vessel is fluidly coupled to a pressure control device. The cleaning vessel seals sufficiently to be pressurized or de-pressurized by the pressure control device. The system further includes a controller that commands the pressure control device to change the pressure in the cleaning vessel such that solvent in the cleaning vessel crosses from a liquid side to a vapor side of a liquid-vapor phase line during a cleaning operation.

An exemplary pressure control device changes the pressure by de-pressurizing the cleaning vessel until the solvent in the cleaning vessel crosses from the liquid side to the vapor side. Another exemplary pressure control device pressurizes the cleaning vessel and a temperature control device elevates the temperature of the solvent in the cleaning vessel, while the solvent remains in a liquid state before a cleaning operation. The exemplary pressure device then reduces the pressure until the solvent in the cleaning vessel crosses from the liquid to the vapor side of the liquid-vapor phase line.

The controller may command the pressure control device to repeat the pressure reduction cycles a number of times. An exemplary system further includes the cleaning vessel thermally coupled to a temperature control device, where the controller commands the temperature control device to reheat the solvent in response to a temperature of the solvent going below a threshold temperature. In certain embodiments, the exemplary controller commands the pressure device to re-pressurize the cleaning vessel before the reheating to ensure the temperature control device does not cause vaporization of isolated portions of the solvent.

The exemplary system further includes a heat curing device that heats the cleaned green ceramic component sufficiently to cure the ceramic component. In certain embodiments, the system includes a positioning device. The positioning device positions the green ceramic component in the cleaning vessel to vertically orient a surface of the ceramic component during the cleaning operation. Additionally or alternatively, the positioning device rotates the green ceramic component during the cleaning operation.

Yet another exemplary embodiment is a method including generating a computer solid model of a component, converting a computer solid model to a stereo-lithographic instruction file, and preparing the component in a stereo-lithography machine in response to the stereo-lithographic instruction file. The method further includes providing an amount of solvent, where a residue from preparing the component is at least partially soluble in the solvent. The method further includes immersing at least part of the component in the solvent, heating the solvent in a liquid state, and reducing a pressure of the solvent sufficiently to boil the solvent. The method further includes heat-curing the component.

The exemplary method further includes casting a metal component having complex internal structures utilizing the component as a casting core, where the component is a ceramic component. The metal component may be any shape, including a complex shape, a shape having internal passages, and/or a shape including an airfoil. In certain embodiments, the method includes repeating the heating and reducing operations to remove the residue from the component. The method includes reducing the pressure of the solvent to keep the solvent on a vapor side of a liquid-vapor phase line. The method further includes monitoring a temperature of the solvent, and in response to the temperature of the solvent being below a threshold temperature, stopping the reducing, then repeating the heating and reducing. The exemplary method further includes repeating the reducing to cycle the solvent across the liquid-vapor phase line.

While the invention has been described in connection with what is presently considered to be the most practical and preferred embodiment, it is to be understood that the invention is not to be limited to the disclosed embodiment(s), but on the contrary, is intended to cover various modifications and equivalent arrangements included within the spirit and scope of the appended claims, which scope is to be accorded the broadest interpretation so as to encompass all such modifications and equivalent structures as permitted under the law. Furthermore it should be understood that while the use of the word preferable, preferably, or preferred in the description above indicates that feature so described may be more desirable, it nonetheless may not be necessary and any embodiment lacking the same may be contemplated as within the scope of the invention, that scope being defined by the claims that follow. In reading the claims it is intended that when words such as "a," "an," "at least one" and "at least a portion" are used, there is no intention to limit the claim to only one item unless specifically stated to the contrary in the claim. Further, when the language "at least a portion" and/or "a portion" is used the item may include a portion and/or the entire item unless specifically stated to the contrary.

What is claimed is:

1. A method for cleaning a residue from a green ceramic component, comprising:

forming a green ceramic component from a photo-responsive fluid using a stereo-lithographic operation, wherein a residue comprises a resin from the photo-responsive fluid used in the stereo-lithographic operation;

providing an amount of solvent, wherein a residue from the photo-responsive fluid is at least partially soluble in the solvent;

immersing at least a portion of the green ceramic component having the residue in the solvent;

heating the solvent in a liquid state; and reducing a pressure of the solvent sufficiently to boil the solvent.

2. The method of claim 1, further comprising monitoring a temperature of the solvent, and further reducing the pressure of the solvent in response to the temperature of the solvent approaching a liquid-vapor phase temperature.

3. The method of claim 1, further comprising vertically orienting a surface of the green ceramic component that is to be cleaned.

4. The method of claim 1, further comprising rotating the green ceramic component during the reducing the pressure of the solvent.

5. The method of claim 1, further comprising reducing the pressure of the solvent sufficiently to put the solvent into a superheated state.

6. The method of claim 1, wherein the reducing the pressure of the solvent comprises one of reducing the pressure of the solvent from an elevated state toward atmospheric pressure and reducing the pressure of the solvent from atmospheric pressure to a reduced pressure.

7. The method of claim 1, further comprising providing the amount of solvent in a vessel, and sealing the vessel from external mass transfer during at least one of the heating and reducing.

8. A method, comprising:

generating a computer solid model of a component;

converting a computer solid model to a stereo-lithographic instruction file;

preparing the component from a photo-sensitive fluid in a stereo-lithography machine in response to the stereo-lithographic instruction file;

providing an amount of solvent, wherein a residue from the photo-sensitive fluid from the preparing is at least partially soluble in the solvent;

immersing at least a portion of the component in the solvent;

heating the solvent in a liquid state;

reducing a pressure of the solvent sufficiently to boil the solvent; and heat-curing the component.

9. The method of claim 8, wherein the component comprises a ceramic component, the method further comprising casting a metal component having complex internal structures utilizing the ceramic component as a casting core.

10. The method of claim 9, wherein the metal component comprises at least one airfoil.

11. The method of claim 8, further comprising repeating the heating and reducing operations to remove the residue from the component.

12. The method of claim 8, wherein the reducing is continued to keep the solvent on a vapor side of a liquid-vapor phase line.

13. The method of claim 12, further comprising monitoring a temperature of the solvent, and in response to the temperature of the solvent being below a threshold temperature, stopping the reducing, then repeating the heating and reducing.

14. The method of claim 8, wherein the reducing is repeated to cycle the solvent across a liquid-vapor phase line.

* * * * *